United States Patent [19]

Ricketts et al.

[11] Patent Number: 4,513,665

[45] Date of Patent: Apr. 30, 1985

[54] METHOD FOR LOADING EXPLOSIVE CHARGES INTO BLASTHOLES FORMED IN A SUBTERRANEAN FORMATION

[75] Inventors: Thomas E. Ricketts; John E. Shaler, both of Grand Junction, Colo.

[73] Assignee: Occidental Oil Shale, Inc., Grand Junction, Colo.

[21] Appl. No.: 501,384

[22] Filed: Jun. 6, 1983

[51] Int. Cl.[3] ..... F42D 3/00

[52] U.S. Cl. ..... 102/312; 102/313; 102/200; 102/321; 299/13; 166/299; 86/20 C

[58] Field of Search ..... 102/312, 313, 200, 202.11, 102/321; 299/2, 13; 166/259, 299; 86/20 C

[56] References Cited

U.S. PATENT DOCUMENTS

| | | | |
|---|---|---|---|
| 3,707,188 | 12/1972 | Heckman | 166/299 X |
| 4,063,509 | 12/1977 | Leonard et al. | 102/313 X |
| 4,164,886 | 8/1979 | Hallmark | 102/313 X |
| 4,248,303 | 2/1981 | Charpentier | 102/299 |
| 4,359,246 | 11/1982 | Ricketts | 102/312 X |
| 4,360,233 | 11/1982 | Ricketts | 102/312 X |
| 4,366,987 | 1/1983 | Ricketts et al. | 102/312 X |
| 4,402,550 | 9/1983 | Ricketts | 102/312 X |
| 4,440,447 | 4/1984 | Ricketts et al. | 102/312 X |
| 4,444,433 | 4/1984 | Ricketts | 166/299 X |

*Primary Examiner*—Peter A. Nelson

*Attorney, Agent, or Firm*—Christie, Parker & Hale

[57] ABSTRACT

A method for loading explosive charges into blastholes in a subterranean formation for forming a fragmented permeable mass of formation particles in an underground cavity in the formation is provided. Upper and lower voids spaced apart vertically from each other by unfragmented formation are excavated into the subterranean formation. A generally vertical blasthole is formed in the unfragmented formation between the voids. Upper and lower explosive charges, separated from one another by stemming, are formed in the blasthole. Each such explosive charge includes at least one primer operationally connected to an explosive initiating lead that extends from the charge. The explosive initiating lead of the upper explosive charge extends from the top of the blasthole into the upper void and the explosive initiating lead of the lower explosive charge extends from the bottom of the blasthole into the lower void. The upper and lower explosive charges are detonated for explosively expanding unfragmented formation toward the voids to thereby form the fragmented permeable mass of formation particles in the underground cavity.

27 Claims, 2 Drawing Figures

METHOD FOR LOADING EXPLOSIVE CHARGES INTO BLASTHOLES FORMED IN A SUBTERRANEAN FORMATION

FIELD OF THE INVENTION

This invention relates to a method for forming an in situ oil shale retort containing a fragmented permeable mass of formation particles in a subterranean formation containing oil shale. More particularly, the invention relates to a method for loading blastholes with the explosive charges that are used for explosively expanding unfragmented formation to form the fragmented mass in the retort.

BACKGROUND OF THE INVENTION

The presence of large deposits of oil shale in the semi-arid, high plateau region of the western United States has given rise to extensive efforts to develop methods of recovering shale oil from kerogen in the oil shale deposits. It should be noted that the term "oil shale" as used in the industry is, in fact, a misnomer; it is neither shale nor does it contain oil. It is a sedimentary formation comprising a marlstone deposit with layers containing an organic polymer called "kerogen" which, upon heating, decomposes to produce liquid and gaseous products, including hydrocarbon products. It is the formation containing kerogen that is called "oil shale" herein and the liquid hydrocarbon product is called "shale oil".

A number of methods have been proposed for processing oil shale which involve either mining the kerogen-bearing shale and processing the shale on the surface or processing the shale in situ. The latter approach is preferable from the standpoint of environmental impact since the spent shale remains in place, reducing the chance of surface contamination and the requirement for disposal of solid wastes. According to both of these approaches, oil shale is retorted by heating the oil shale to a sufficient temperature to decompose kerogen and produce shale oil which drains from the rock. The retorted shale, after kerogen decomposition, contains substantial amounts of residual carbonaceous material which can be burned to supply heat for retorting.

One technique for recovering shale oil includes forming an in situ oil shale retort in a subterranean formation containing oil shale. At least a portion of the formation within the boundaries of the in situ oil shale retort is explosively expanded to form a fragmented permeable mass of particles containing oil shale. The fragmented mass is ignited near the top of the retort to establish a combustion zone. An oxygen-supplying gas is introduced into the top of the retort to sustain the combustion zone and cause it to move downwardly through the fragmented permeable mass of particles in the retort. As burning proceeds, the heat of combustion is transferred to the fragmented mass of particles below the combustion zone to release shale oil and gaseous products therefrom in a retorting zone. The retorting zone moves from the top to the bottom of the retort ahead of the combustion zone and the resulting shale oil and gaseous products pass to the bottom of the retort for collection and removal. Recovery of liquid and gaseous products from oil shale deposits is described in greater detail in U.S. Pat. No. 3,661,423 to Donald E. Garrett which is incorporated herein by this reference.

Examples of techniques used for forming in situ oil shale retorts are described in U.S. Pat. Nos. 4,043,597 to French, 4,043,598 to French et al, and 4,192,554 to Ricketts. According to these patents, at least two voids vertically spaced apart from each other are excavated in a subterranean formation leaving zones of unfragmented formation between adjacent voids. Explosive is placed in blasting holes formed in the zones of unfragmented formation. The explosive is then detonated to expand formation toward the voids to form a fragmented mass having a void volume about equal to the void volume of the initial voids. U.S. Pat. Nos. 4,043,597, 4,043,598, and 4,192,554 are incorporated herein by this reference.

A fragmented mass of formation particles formed in a retort preferably has a reasonably uniformly distributed void fraction and permeability so that gases can flow relatively uniformly through the retort during retorting operations. This avoids gas bypassing of portions of the fragmented mass, as can occur if there is channelling due to non-uniform permeability and, thus, enhances the yield of liquid and gaseous products from the retort.

When formation is prepared for explosive expansion toward one or more voids in a subterranean formation for forming a fragmented mass in a retort, it sometimes is desirable to place more than one explosive charge into a single long blasthole. Such charges are spaced apart from each other by stemming with inert materials such as sand or gravel or the like. In some instances, it is desirable to detonate each of these separate charges at a different time in a single round of explosions coordinated with detonations of explosive charges in other blastholes in the formation. In such a blast, it is important that each charge is detonated and that such a detonation is at the proper time in the sequence so that the fragmented mass formed has the desired uniformity of void fraction distribution and permeability.

One problem caused by using a time delay method of blasting is that ground movement and/or airborne rock fragments ejected from a previous explosion can sever explosive initiating means. The initiating means, for example, can be trunk lines containing tie-up systems of detonating cord and time delay devices. Severing a trunk line can result in cutoff of a blasthole or blastholes serviced by the severed trunk line where the explosive in the blasthole is not initiated due to the severance. Lack of initiation of explosive in the blastholes causes formation in the area to remain unfragmented, resulting in an uneven distribution of void fraction or permeability of the fragmented mass in the retort.

In order to substantially decrease the probability of having a cut off blasthole, it is desirable to initiate all of the explosive trains downhole at the same time prior to the first explosions in a round of time delay explosions. Explosive trains include initiating devices such as detonating time delays and their associated detonating cords.

In one method of expanding unfragmented formation in a single round of time delay explosions, a plurality of long vertical blastholes are drilled into a subterranean formation from a void space above the formation. A first explosive charge is placed into the bottom of the blasthole, stemming is placed above the first charge, and a second charge is placed into the blasthole above the stemming. Associated with each explosive charge is at least one primer and an associated detonating time delay device. In many instances, a plurality of primers are used for each charge to provide redundancy.

In an exemplary technique, two primers are embedded in the first explosive charge at the bottom of the blasthole. If desired, a pair of time delay detonators may be placed in each primer. The detonating time delay device embedded in each primer is connected to a separate detonating cord lead, each of which extends up the blasthole, through the second explosive charge, and out the top of the blasthole into the void space above. Additionally, one or more, and in this instance two, primers and their associated time delay devices are embedded in the second explosive charge. A detonating cord lead is connected to each of the two detonating time delay devices associated with the second charge and each lead extends upwardly from the second explosive charge and out the top of the blasthole into the void space. In this instance, therefore, four detonating cord leads associated with the four time delay devices are in the blasthole and pass through the second explosive charge.

All four detonating cord leads are initiated at about the same time so that, in turn, the time delay device associated with each respective lead is initiated downhole at about the same time as each other time delay. Thus, energy from the detonation of all four leads is transmitted about simultaneously to the second explosive charge. The amount of energy released can be sufficient to cause the second charge to detonate prematurely. Such premature detonation can cause an uneven distribution of void fraction or permeability in the fragmented mass which can result in gas channelling and bypassing of portions of the fragmented mass as is described above.

In addition, detonation of the first explosive charge in such a blasthole can be less reliable than desired. For example, during loading of the stemming and second explosive charge, or when the first charge slumps or settles in the bottom of the blasthole, the detonating cords or other explosive initiating leads, such as electrical leads used with electrically initiated blasting caps, that extend from the first charge can be severed. In this case, the first charge will not detonate and, thus, the fragmented mass formed in the retort may not be as uniformly permeable as desired.

Loading explosive into blastholes also becomes increasingly more difficult as the number of downlines, i.e , explosive initiating leads, increases due to hangup and tangled lines and the like.

It is, therefore, desirable to provide a method of enhanced reliability for explosively expanding unfragmented formation when using long blastholes containing more than one explosive charge.

SUMMARY OF THE INVENTION

This invention relates to a method for loading more than one explosive charge into a blasthole formed in a subterranean formation between two void spaces. A first explosive charge is formed in a lower portion of the blasthole adjacent a first void space. The first explosive charge comprises at least one detonator operationally connected to a first explosive initiating lead that extends into the first void space. A second explosive charge is formed in a portion of the blasthole adjacent a second void space. The second explosive charge comprises at least one detonator operationally connected to a second explosive initiating lead that extends into the second void space. The explosive initiating leads are tied into trunk lines and the explosive charges are detonated.

DRAWINGS

These and other features, aspects, and advantages of the present invention will be more fully understood when considered with respect to the following detailed description, appended claims, and accompanying drawings wherein:

FIG. 1 is a semi-schematic, fragmentary, vertical, cross-sectional view of a subterranean formation prepared for explosive expansion in accordance with practice of principles of this invention; and FIG. 2 is a semi-schematic, fragmentary, vertical, cross-sectional view of an exemplary in situ oil shale retort at one stage in preparation in accordance with practice of principles of this invention.

DETAILED DESCRIPTION

Figure 1:
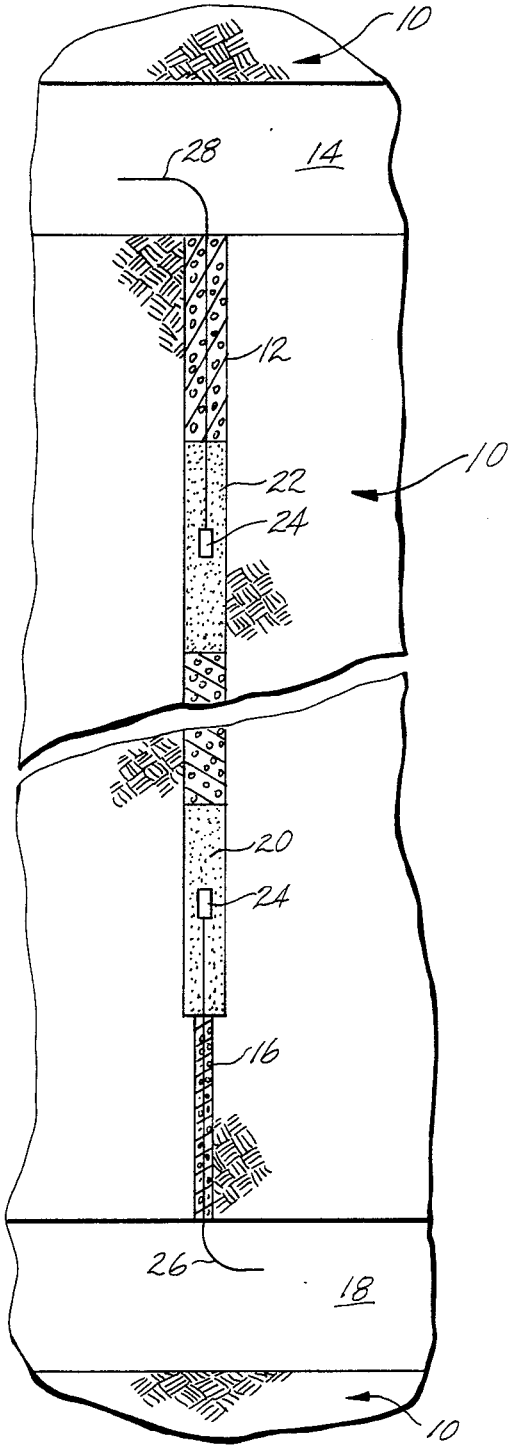

Referring to FIG. 1, there is shown a fragmentary, vertical, semi-schematic, cross-sectional view of a subterranean formation 10 prepared for explosive expansion in accordance with practice of principles of this invention. A long, generally vertical blasthole 12 is drilled into the formation 10 from an upper void space 14 above the blasthole or from the ground surface. A borehole 16 is formed between the bottom of the blasthole 12 and a lower void space 18 below the blasthole.

When long blastholes are used for loading explosive charges into a formation, it is sometimes desirable to place a plurality of mutually spaced apart explosive charges into such a blasthole. In the illustrated embodiment, two explosive charges are shown in the blasthole 12, a lower explosive charge 20 adjacent the lower void space 18 and an upper explosive charge 22 adjacent the upper void space 14. More than two explosive charges can be used if desired.

Each explosive charge 20 and 22 comprises at least one primer or booster 24 having a detonating time delay device or detonator (not separately illustrated) embedded therein connected to a detonating cord lead. For example, a detonating cord lead 26 is operationally connected to, and extends from, the primer 24 of the explosive charge 20 and a detonating cord lead 28 is operationally connected to, and extends from, the primer 24 of the explosive charge 22. Primers, detonating time delay devices, and detonating cords useful in practice of this invention are commercially available.

In accordance with practice of this invention, when more than two charges are in a blasthole, the detonating cord lead from at least the charge nearest the void above the blasthole extends into that void and the detonating cord lead from at least the charge nearest the void below the blasthole extends into that void. For example, the detonating cord lead 26 of the lower charge 20 extends through the borehole 16 into the lower void space 18 and the detonating cord lead 28 of the upper charge 22 extends into the upper void space 14 above the blasthole.

The explosive charges 20 and 22 are then detonated for explosively expanding unfragmented formation toward the voids 14 and 18 to form a fragmented mass of formation particles in an underground cavity.

Although practice of this invention is applicable for loading blastholes with explosive charges for explosively expanding any subterranean formation, it is described below in detail with reference to explosively expanding a subterranean formation containing oil shale to form a fragmented permeable mass of formation particles in an in situ oil shale retort.

Figure 2:
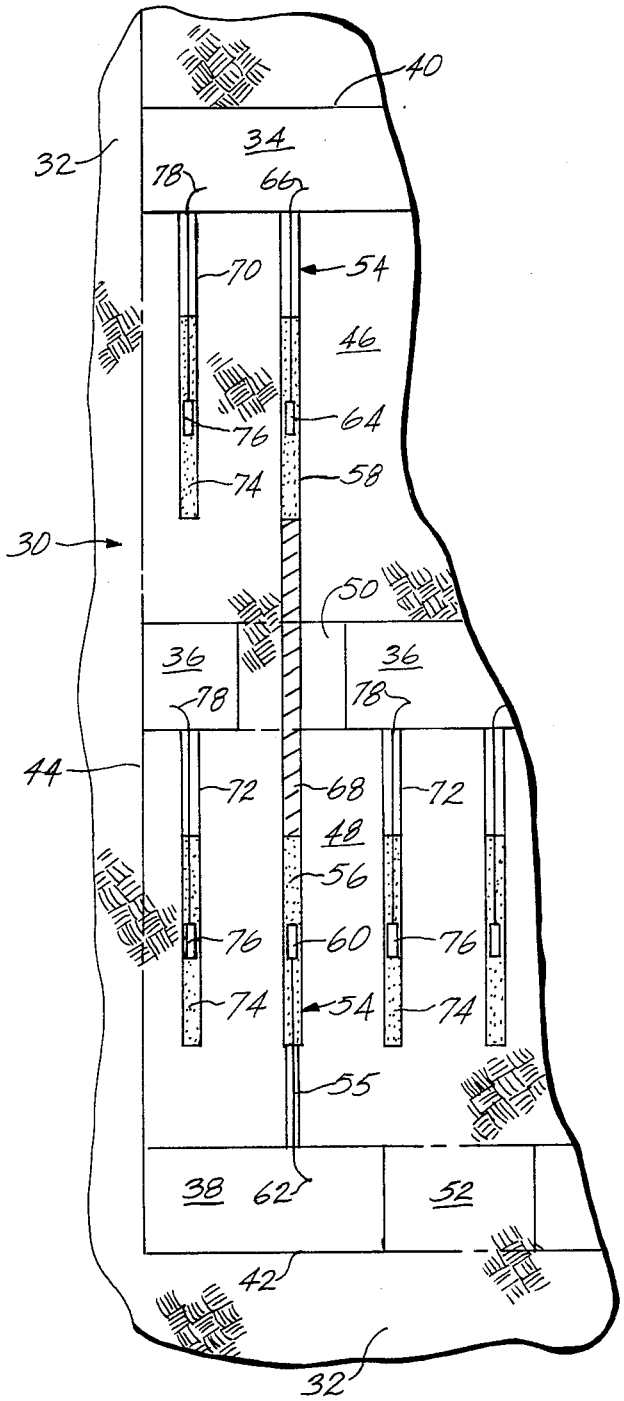

Referring to FIG. 2, there is shown a fragmentary, semi-schematic, vertical, cross-sectional view of an exemplary in situ oil shale retort 30 at one stage in preparation in accordance with practice of principles of this invention. The retort 30 is being formed in a retort site in a subterranean formation 32 containing oil shale. An upper void 34, an intermediate void 36, and a lower void 38 are excavated one above the other within the retort top, bottom, and vertically extending side boundaries 40, 42, and 44, respectively, of unfragmented formation. An upper zone 46 of unfragmented formation extends between the upper and intermediate voids and a lower zone 48 of unfragmented formation extends between the intermediate and lower voids.

At least one support pillar 50 of unfragmented formation is left in the intermediate void to provide temporary support for overlying unfragmented formation. Additionally, at least one support pillar 52 of unfragmented formation is left in the lower void. Support pillars (not shown) can also be left in the upper void if desired.

The support pillars 50 and 52 and zones of unfragmented formation 46 and 48 are loaded with explosive charges and the charges are detonated for explosively expanding formation toward the voids to form the fragmented mass of formation particles (not shown) in the retort 30.

When a support pillar of unfragmented formation, such as the pillar 50, is left in the intermediate void 36, vertical access to the unfragmented formation below the pillar is not possible from that void. Therefore, to provide explosive charges in the zone of unfragmented formation 48 below the pillar 50, one or more long vertical blastholes 54 are drilled from the upper void 34 through the upper zone 46, the pillar 50, and through a portion of the lower zone 48 of unfragmented formation. (Only one such blasthole 54 is shown for simplicity.) A borehole 55 is drilled from the bottom of the blasthole 54 through the remaining portion of the lower zone and into the void 38.

A lower explosive charge 56 is provided in a bottom portion of the blasthole 54 in the lower zone 48 of unfragmented formation, while an upper explosive charge 58 is in the top portion of the blasthole in the upper zone 46 of unfragmented formation. The lower explosive charge 56 comprises at least one detonator and primer 60 embedded therein that is operationally connected to a detonating cord lead 62 that extends through the borehole 55 into the lower void 38. The upper explosive charge 58 comprises at least one detonator and primer 64 operationally connected to a detonating cord lead 66 that extends out the top of the blasthole 54 into the upper void 34.

Preferably, explosive charges in the upper zone of unfragmented formation are located at the center of height of that zone and explosive charges in the lower zone of unfragmented formation are located at the center of height of the lower zone. Explosive charges can, however, be located in other regions of the zones of unfragmented formation if desired.

In an exemplary embodiment of forming the in situ retort 30 in accordance with practice of this invention, the upper and lower voids 34 and 38 are about 16 feet high and the intermediate void 36 is about 32 feet high. Both the upper and lower zones 46 and 48 of unfragmented formation are about 90 feet thick. The long vertical blastholes 54 formed through the upper zone 46, the pillar 50, and into the lower zone 48 of unfragmented formation are about 12 inches in diameter and extend through about three-fourths the thickness of the lower zone 48. Thus, the blastholes 54 are about 185–190 feet long. The borehole 55 is about 6 inches in diameter and extends through the remaining 20–25 feet of the lower zone from the bottom of the blasthole 54 into the lower void 38. If desired, boreholes and blastholes having other dimensions can be used in practice of principles of this invention.

As an alternative to forming the 12-inch blastholes 54 through about three-fourths the thickness of the lower zone and then providing the 6-inch borehole 55, a 6-inch pilot hole can initially be drilled from the upper void 34 through the upper zone, the pillar, and the entire thickness of the lower zone. In this embodiment, the pilot hole can then be reamed to its 12-inch diameter in regions extending through the upper zone, the pillar, and three-fourths the thickness of the lower zone, thus leaving a 6-inch borehole extending from the bottom of the reamed portion downwardly through the remaining portion of the lower zone into the lower void. Alternatively, if desired, to save drilling time and expense, only those portions of the blasthole that will contain the explosive charges can be reamed.

In an exemplary embodiment, the lower explosive charge 56 is formed in the blasthole 54 by extending a line such as a rope from the upper void 14 downwardly through the blasthole and out the bottom of the borehole 55 into the lower void. The primer 60 (shown in place in the blasthole) is initially tied to the bottom of the rope in the lower void. The primer has a detonating time delay device (not separately shown) embedded therein and the detonating cord lead 62 is connected to the time delay detonator. The primer is pulled upwardly through the borehole 55 and is held in place in the blasthole 54, preferably at about the center of the lower zone 48 of unfragmented formation. The detonating cord lead 62 extends downwardly from the time delay detonator and out the bottom of the borehole 55 into the void 38.

In an exemplary embodiment, to provide redundancy, two identical primers with time delay detonators and associated detonating cord leads are tied to the rope and pulled up into the center of the lower zone of unfragmented formation through the borehole 55. The two detonating cord leads, therefore, extend down the blasthole 54 and out its bottom into the void. In the drawing, only one primer 60 and detonating cord lead 62 are shown for simplicity.

After the primers 60 are in place in the blasthole 54, the borehole 55 is plugged with grout or gravel or the like (not shown). Tension is maintained on the rope to hold the primer 60 at about the center of height of the lower zone 48. Explosive is then placed into the blasthole 54 from its opening in the upper void 34 to form the explosive charge 56 in the bottom portion of the blasthole. Powder, prill, or slurry explosive flows around the primer suspended in the blasthole. In the exemplary embodiment, the charge 56 has a height of about 45 feet and is in the center of the lower zone of unfragmented formation.

Stemming 68, such as sand or gravel, is then placed into the blasthole 54 above the lower explosive charge 56. The stemming extends from about the top of the charge 56, preferably through about the bottom one-fourth of the thickness of the upper zone 46 of unfragmented formation. In the exemplary embodiment, the stemming column 68 is about 75 feet long.

Two primers 64 and their associated detonating time delay devices (not shown) and detonating cord leads 66 are then tied to a rope and lowered into the blasthole 54 to about the center of height of the upper zone 46 of unfragmented formation. The detonating cord lead 66 from each of the time delay detonators extends upwardly and out the top of the blasthole 54 into the void 34. Only one primer 64 and detonating cord lead 66 is shown for simplicity.

Explosive is then placed into the blasthole 54, on top of the stemming column 68 for forming the upper explosive charge 58 in the upper zone 46 of unfragmented formation. In the exemplary embodiment, the charge 58 has a height of about 45 feet and is in the center of the upper zone of unfragmented formation.

Alternatively, and preferably, explosive comprising the bottom half of the upper charge 58 is initially placed in the blasthole, followed by the primers 64. The remaining explosive comprising the top half of the upper charge is then loaded into the blasthole on top of the primers.

In addition to the long blastholes 54 comprising the vertically spaced apart explosive charges 56 and 58, other blastholes containing only one explosive charge can be used for explosively expanding the upper and lower zones 46 and 48 of unfragmented formation. For example, in the illustrated embodiment, a plurality of generally vertical blastholes 70 (only one of which is shown) are drilled from the upper void 34 into the upper zone 46 of unfragmented formation for use in explosively expanding the upper zone. A plurality of blastholes 72 are drilled from the intermediate void into the lower zone 48 of unfragmented formation for use in explosively expanding the lower zone. The number, spacing, and size of the blastholes 70 and 72 is for illustrative purposes and more or fewer blastholes of different sizes and spacing can be provided as desired. The blastholes 70 and 72, as well as the blasthole 54, are exaggerated in width and spacing in the drawing for clarity.

The blastholes 70 and 72 are each loaded with a single explosive charge 74, including a detonator and primer 76, and associated detonating cord lead 78. The detonating cord leads 78 of the charges 74 in the blastholes 70 extend out the tops of the blastholes into the upper void 34. The detonating cord leads 78 of the charges 74 in the blastholes 72 extend out the tops of the blastholes into the intermediate void 36.

Preferably, the explosive charges 74 are similar to the charges 56 and 58. For example, it is preferable that the charges 74 in the upper zone are at the same elevation in the upper zone as the explosive charge 58 and that the charges 74 in the lower zone are at the same elevation in the lower zone as the explosive charges 56. If desired, however, the charges can be at different elevations.

Explosive is also placed into the pillars 30 and 32; for example, by placing charges in horizontal blastholes (not shown) formed in the pillars.

The detonating cord leads extending into the upper void 34, intermediate void 36, and lower void 38 are tied into trunk lines as is known in the art. The charges are then detonated for explosively expanding the pillars first and then the zones of unfragmented formation toward the voids for forming the fragmented permeable mass of formation particles in the retort.

All of the time delay devices are preferably initiated downhole simultaneously for detonating the charges in a single round of time delay explosions. The term "single round" as used herein means detonation of a number of separate explosive charges, either simultaneously or with only a short time delay between separate detonations. A time delay between explosions in a sequence is considered short when formation expanded by detonation of one charge is either not yet moved or is in motion at the time of detonation of a subsequent charge.

By providing the borehole 55 between the blasthole 54 and the lower void 38 in accordance with practice of this invention, the two detonating cord leads 62 of the lower charge 56 extend out the bottom of the blasthole and into the lower void 38 instead of extending upwardly through the stemming 68 and upper charge 58 and out the top of the blasthole. This enhances the reliability of the blasting operation. For example, the time delay devices in the lower charges 56 are initiated without substantially any energy from their detonating cord leads being transmitted to the upper charge 58. This minimizes the energy transmitted to the charge 58, thereby reducing the chance that it will prematurely detonate.

Because the detonating cord leads 62 extend from the bottom of the blasthole instead of extending up the blasthole and out the top, there is less chance that they will be severed during the loading and stemming operation. Additionally, it has been found that detonating cords that extend up a blasthole through stemming can be pulled apart by settling or slumping of the charge with which they are associated.

An additional advantage of providing the boreholes 55 is that such boreholes drain water that can enter the blasthole 54, thus leaving the blasthole dry for loading. This allows a compact explosive charge to be formed which again enhances the reliability of the blasting operation.

Although the above described embodiments of practice of this invention relate to use of detonating cord leads and associated detonating cord actuated detonators, the use of electrically initiated detonating caps (electric blasting caps) and associated electrical leads is also contemplated. Additionally, the use of detonating tubes such as those provided by Nitro Nobel Co. under the trademark NONEL is contemplated. Thus, the explosive initiating leads can be detonating cord leads or detonating tubes or electrical leads, as appropriate. Further, although practice of this invention is described above with respect to vertical blastholes, blastholes that are positioned at other angles in formation can also be similarly loaded.

The above description of a method for loading explosive charges into blastholes formed in subterranean formations is for illustrative purposes. Because of variations which will be apparent to those skilled in the art, the present invention is not intended to be limited to the particular embodiments described above. The scope of the invention is defined in the following claims.

What is claimed is:

1. A method for loading explosive charges into a blasthole formed in a subterranean formation between two void spaces, the method comprising the steps of:

placing a first explosive charge in a portion of the blasthole adjacent a first void space, the first explosive charge comprising at least one detonator operationally connected to a first explosive initiating lead that extends into the first void space; and placing a second explosive charge in another portion of the blasthole adjacent a second void space, the second explosive charge comprising at least one detonator operationally connected to a second explosive initiating lead that extends into the second void space.

2. The method according to claim 1 wherein the blasthole is generally vertical.

3. The method according to claim 1 wherein the first and second explosive initiating leads are detonating cords.

4. A method for forming a fragmented permeable mass of formation particles in an underground cavity in a subterranean formation, the method comprising the steps of:

excavating a void in the subterranean formation while leaving a zone of unfragmented formation above the void, the bottom surface of the zone of unfragmented formation comprising the roof of the void;

forming at least one generally vertical blasthole in the zone of unfragmented formation from a location above the zone of unfragmented formation;

placing a plurality of vertically spaced apart explosive charges in the blasthole, each such explosive charge comprising at least one detonator operationally connected to an explosive initiating lead, each such explosive initiating lead of the explosive charge nearest the bottom of the blasthole extending downwardly from the blasthole into the void, and each such explosive initiating lead of the explosive charge nearest the top of the blasthole extending upwardly out the top of the blasthole; and detonating the plurality of explosive charges in the blasthole for explosively expanding unfragmented formation toward the void to thereby form a fragmented permeable mass of formation particles in the underground cavity.

5. The method according to claim 4 wherein the plurality of explosive charges are detonated in a single round.

6. A method for loading explosive charges into a generally vertical blasthole formed in a subterranean formation between two void spaces, the method comprising the steps of:

placing a lower explosive charge in a lower portion of the blasthole, the lower explosive charge comprising at least one detonating time delay device connected to means for initiating the detonating time delay device that extends into a lower void space below the blasthole; and placing an upper explosive charge in an upper portion of the blasthole spaced apart vertically from the lower charge, the upper charge comprising at least one detonating time delay device connected to means for initiating the detonating time delay device that extends into an upper void space above the blasthole.

7. The method according to claim 6 wherein the means for initiating the detonating time delay device of the lower explosive charge extends into the lower void through a borehole that extends from the bottom of the blasthole into the lower void space, the diameter of the borehole being smaller than the diameter of the blasthole.

8. A method for forming a fragmented permeable mass of formation particles in an underground cavity in a subterranean formation, comprising the steps of:

excavating upper and lower voids in the subterranean formation spaced apart vertically from each other by unfragmented formation;

forming a generally vertical blasthole in the unfragmented formation between the voids;

placing upper and lower explosive charges in the blasthole separated from one another by stemming, each such charge comprising at least one detonating time delay device having an explosive initiating lead extending therefrom, the explosive initiating lead of the time delay device comprising the upper charge extending from the top of the blasthole into the upper void and the explosive initiating lead of the time delay device comprising the lower charge extending from the bottom of the blasthole into the lower void; and initiating detonation of the upper and lower charges in a single round for explosively expanding unfragmented formation toward the upper and lower voids to thereby form a fragmented permeable mass of formation particles in the retort.

9. The method according to claim 8 wherein each such explosive initiating lead is a detonating cord.

10. A method for forming an in situ oil shale retort in a subterranean formation containing oil shale, the retort having top, bottom, and side boundaries of unfragmented formation, the method comprising the steps of:

excavating formation from within the boundaries of the retort being formed to form at least three voids therein, an upper void spaced apart vertically above an intermediate void and a lower void spaced apart vertically below the intermediate void, an upper zone of unfragmented formation extending between the upper and intermediate voids and a lower zone of unfragmented formation extending between the intermediate and lower voids, at least one pillar of unfragmented formation being left in the intermediate void extending between the upper and lower zones of unfragmented formation to support overlying formation;

forming at least one generally vertical blasthole from the upper void extending through the upper zone of unfragmented formation, the pillar of unfragmented formation, and into the lower zone of unfragmented formation;

forming a borehole extending from the bottom of the blasthole into the lower void;

loading explosive into the blasthole from the upper void to form a lower explosive charge in the lower zone of unfragmented formation, the lower charge comprising a detonator operationally connected to an explosive initiating lead that extends downwardly through the borehole into the lower void;

loading stemming into the blasthole onto the top of the lower explosive charge, the stemming extending from the top of the lower charge through the pillar and into a lower region of the upper zone of unfragmented formation;

loading explosive into the blasthole from the upper void onto the top of the stemming to form an upper explosive charge in the upper zone of unfragmented formation, the upper charge comprising a detonator operationally connected to an explosive initiating lead that extends into the upper void; and detonating the upper and lower explosive charges in the blasthole to explosively expand the upper and lower zones of unfragmented formation toward the voids for forming a fragmented permeable mass of formation particles in the retort.

11. The method according to claim 10 wherein such an upper explosive charge is at about the center of height of the upper zone of unfragmented formation and such a lower explosive charge is at about the center of height of the lower zone of unfragmented formation.

12. The method according to claim 11 wherein the detonator associated with each such upper and lower explosive charge is located at about the center of height of its respective charge.

13. A method for forming an in situ oil shale retort in a subterranean formation containing oil shale, the retort having top, bottom, and side boundaries of unfragmented formation, the method comprising the steps of:

excavating formation from within the boundaries of the retort being formed to form at least three voids therein, an upper void spaced apart vertically above an intermediate void and a lower void spaced apart vertically below the intermediate void, an upper zone of unfragmented formation extending between the upper and intermediate voids and a lower zone of unfragmented formation extending between the intermediate and lower voids, at least one pillar of unfragmented formation being left in the intermediate void extending between the upper and lower zones of unfragmented formation to support overlying formation;

forming at least one generally vertical blasthole from the upper void extending through the upper zone of unfragmented formation, the pillar of unfragmented formation, and into the lower zone of unfragmented formation;

forming a borehole from the bottom of the blasthole to the lower void;

extending a line from the upper void downwardly through the blasthole and the borehole into the lower void;

tying at least one primer and associated detonating time delay device connected to an explosive initiating lead to the end of the line in the lower void and pulling the primer upwardly through the borehole into the blasthole for positioning the primer in a region of the lower zone of unfragmented formation while leaving the explosive initiating lead extending from the bottom of the borehole into the lower void;

loading explosive into the blasthole from the upper void to form a lower explosive charge in the lower zone of unfragmented formation with the primer being embedded in the explosive comprising the lower explosive charge;

loading stemming into the blasthole onto the top of the lower explosive charge, such stemming extending from the top of the lower charge into a lower portion of the upper zone of unfragmented formation, thereafter forming an upper explosive charge in a region of the upper zone of unfragmented formation by:

lowering a primer and associated detonating time delay device connected to an explosive initiating lead into the blasthole for positioning the primer in a region of the upper zone of unfragmented formation, while leaving the explosive initiating lead extending out the top of the blasthole into the upper void;

loading explosive into the blasthole to provide the upper explosive charge in the upper zone of unfragmented formation; and detonating the upper and lower explosive charges in the blasthole to explosively expand unfragmented formation of the upper and lower zones of unfragmented formation toward the voids for forming a fragmented permeable mass of formation particles in the retort.

14. The method according to claim 13 comprising forming the explosive charges in the region of the upper zone of unfragmented formation by:

loading a first portion of explosive into the blasthole from the upper void onto the top of the stemming to provide the bottom segment of an upper explosive charge in the upper zone of unfragmented formation; thereafter lowering a primer and associated detonating time delay device connected to an explosive initiating lead into the blasthole onto the bottom segment of the upper explosive charge, while leaving the explosive initiating lead extending out the top of the blasthole into the upper void; thereafter loading a remaining portion of explosive into the blasthole to provide the top segment of the upper explosive charge in the upper zone of unfragmented formation.

15. The method according to claim 13 wherein the upper explosive charge is at about the center of height of the upper zone of unfragmented formation and the lower explosive charge is at about the center of height of the lower zone of unfragmented formation.

16. The method according to claim 15 wherein the primer in the lower explosive charge is at about the center of height of the lower charge and the primer in the upper explosive charge is at about the center of height of the upper charge.

17. The method according to claim 13 wherein the upper and lower charges are detonated in a single round time delay sequence.

18. A subterranean formation prepared for explosive expansion comprising:

a blasthole in the formation communicating with a first void space at one end of the blasthole and a second void space at the other end of the blasthole;

a first explosive charge in a portion of the blasthole adjacent the first void space operationally connected to an explosive initiating lead that extends out the end of the blasthole into the first void space; and a second explosive charge in a portion of the blasthole adjacent the second void space operationally connected to an explosive initiating lead that extends from the end of the blasthole into the second void space.

19. The subterranean formation as claimed in claim 18 wherein each such explosive initiating lead is a detonating cord.

20. A subterranean formation prepared for explosive expansion comprising:

a generally vertical blasthole in the formation communicating with an upper void space above the blasthole and a lower void space below the blasthole;

a first explosive charge in a lower portion of the blasthole operationally connected to a detonating cord lead that extends out the lower end of the blasthole into the lower void space; and a second explosive charge in an upper portion of the blasthole operationally connected to a detonating cord lead that extends from the upper end of the blasthole into the upper void space.

21. The method according to claim 20 wherein each such first and second explosive charge comprises at least one primer and associated detonating time delay device connected to the detonating cord lead.

22. The subterranean formation claimed in claim 21 wherein the first and second explosive charges each comprise two primers, associated detonating time delay devices and detonating cord leads where the two detonating cord leads of the first explosive charge extend from the lower end of the blasthole into the lower void space and the two detonating cord leads of the second explosive charge extend from the upper end of the blasthole into the upper void space.

23. A subterranean oil shale formation prepared for explosive expansion for forming a fragmented permeable mass of formation particles in an in situ oil shale retort having top, bottom, and side boundaries of unfragmented formation, the subterranean formation comprising:

a generally vertical blasthole within the retort boundaries between an upper void space within the retort boundaries above the blasthole and a lower void space within the retort boundaries below the blasthole; and at least two vertically spaced apart explosive charges in the blasthole:

a lower explosive charge nearest the bottom of the blasthole operationally connected to an explosive initiating lead that extends from the bottom end of the blasthole into the lower void space; and an upper explosive charge nearest the top of the blasthole operationally connected to an explosive initiating lead that extends from the top of the blasthole into the upper void space.

24. The subterranean oil shale formation according to claim 23 wherein only two explosive charges are in the blasthole.

25. The method according to claim 23 wherein the explosive initiating leads are detonating cords.

26. A subterranean oil shale formation prepared for explosive expansion for forming a fragmented permeable mass of formation particles in an in situ oil shale retort having top, bottom, and side boundaries of unfragmented formation, the subterranean formation comprising:

a generally vertical blasthole within the retort boundaries; and at least two vertically spaced apart explosive charges in the blasthole:

a lower explosive charge nearest the bottom of the blasthole comprising at least one detonating time delay device having a detonating cord lead attached thereto to initiate detonation of the first explosive charge; and an upper explosive charge nearest the top of the blasthole comprising at least one detonating time delay device having a detonating cord lead attached thereto to initiate detonation of the second explosive charge, wherein such a detonating cord lead associated with the lower explosive charge extends downwardly in the blasthole away from the upper charge and such a detonating cord lead associated with the upper explosive charge extends upwardly in the blasthole away from the lower charge so that, upon initiation of the detonating cord leads, substantially no energy from the detonating cord lead associated with the lower explosive charge is transmitted to the upper explosive charge and substantially no energy from the detonating cord lead associated with the upper explosive charge is transmitted to the lower explosive charge.

27. The subterranean oil shale formation according to claim 26 wherein the upper and lower explosive charges each comprise two detonators, associated time delay devices, and detonating cord leads where the two detonating cord leads of the lower explosive charge extend downwardly in the blasthole away from the upper charge and the two detonating cord leads of the upper explosive charge extend upwardly in the blasthole away from the lower charges.

* * * * *